United States Patent [19]

Eriksen

[11] 4,076,253

[45] Feb. 28, 1978

[54] EDUCATIONAL PUZZLE

[76] Inventor: Diane W. Eriksen, 1796 Macapin St., West Milford, N.J. 08848

[21] Appl. No.: 704,726

[22] Filed: Jul. 12, 1976

[51] Int. Cl.[2] ..... A63F 9/10

[52] U.S. Cl. ..... 273/157 R; 35/31 G; 35/35 J; 35/70; 35/71; 273/294; 273/299

[58] Field of Search ..... 273/157 R, 137 C, 137 D, 273/152.7 R; 35/31 G, 70, 72, 73

[56] References Cited

U.S. PATENT DOCUMENTS

| | | | |
|---|---|---|---|
| 723,425 | 3/1903 | Thompson | 273/157 R UX |
| 928,540 | 7/1909 | Rawitch | 273/157 R |
| 1,230,263 | 6/1917 | Alexander | 273/157 R X |
| 1,676,641 | 7/1928 | Eschenbach | 273/157 R |
| 3,171,214 | 3/1965 | Sutherland | 273/157 R X |

FOREIGN PATENT DOCUMENTS

| | | | |
|---|---|---|---|
| 986,961 | 4/1951 | France | 273/157 R |
| 1,330,709 | 5/1963 | France | 273/137 C |
| 553,798 | 6/1943 | United Kingdom | 273/157 R |

OTHER PUBLICATIONS

Educational Design Associates Catalog, copyrighted Jan. 1973, p. 1.

*Primary Examiner*—Anton O. Oechsle
*Attorney, Agent, or Firm*—Ladas, Parry, Von Gehr, Goldsmith & Deschamps

[57] ABSTRACT

An educational puzzle adapted to be assembled to form a predetermined figure including a plurality of substantially flat components each having at least one counterpart edge that is intended to be placed in juxtaposition with a counterpart edge located on another of the components. Each component has a printed portion located along, and associated with each counterpart edge thereof, and the printed portions cooperate to indicate a pair of counterpart edges which are located on separate components and are complementary. The complementary counterpart edges are of suitable shape whereby they are intended to be placed into coextensive engagement to form a predetermined figure or symbol.

2 Claims, 6 Drawing Figures

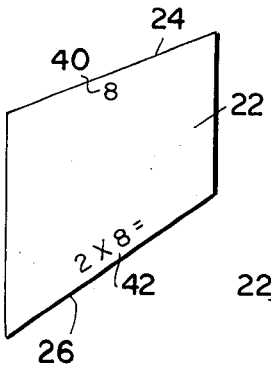
FIG. 1
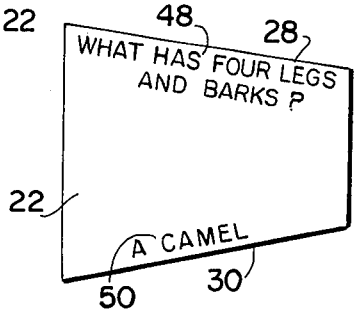
FIG. 2
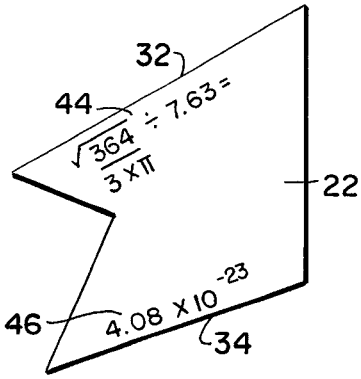
FIG. 3
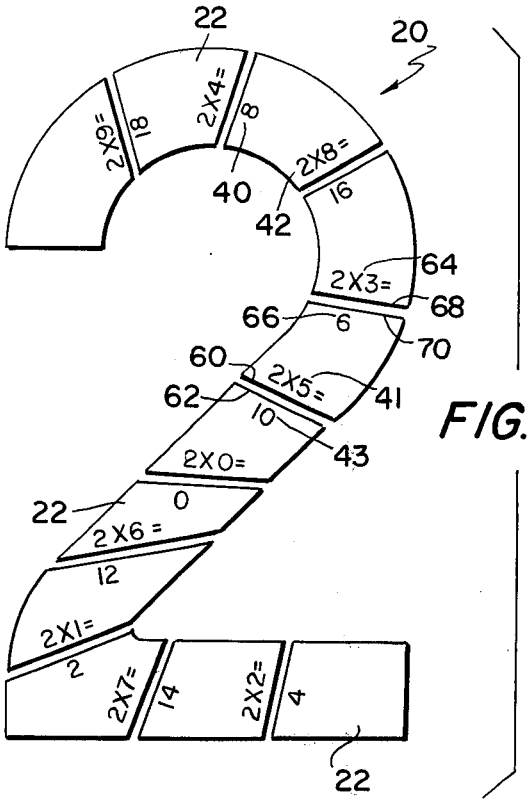
FIG. 4
FIG. 5
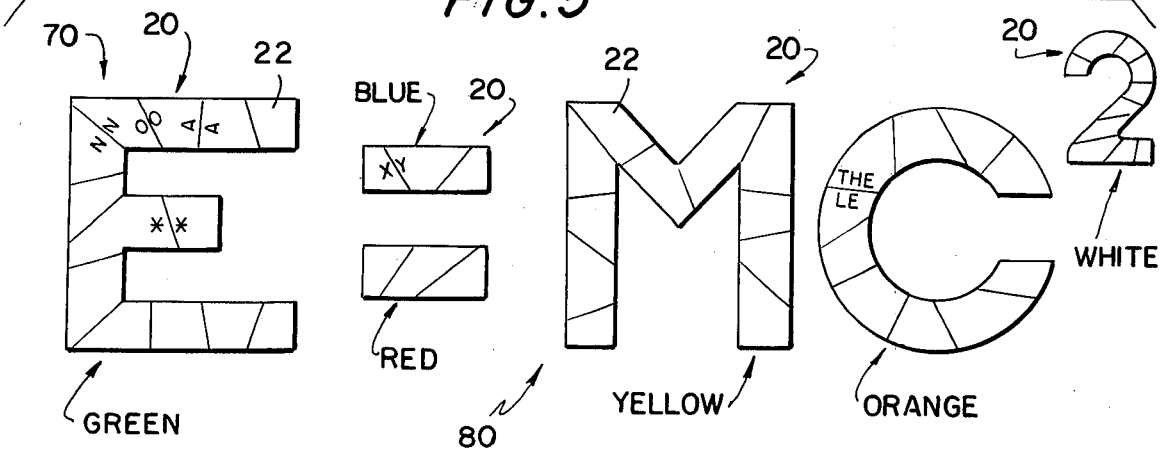

EDUCATIONAL PUZZLE

BACKGROUND OF THE INVENTION

1. Field of the Invention

This invention relates to a puzzle and more particularly to an educational puzzle that is especially adapted for use with children in connection with learning mathematics and the like. The puzzle provides a plurality of components which bear printed matter including questions or mathematical problems, as well as answers which when placed in the proper position form a figure thereby providing positive reinforcement during a learning process.

2. Description of the Prior Art

Various types of cue cards and simple electronic devices have been used in the past as a teaching aid and for entertainment purposes which are intended to assist in the learning process of mathematics and the like. These various attempts have been made to present a problem or question whereby the suitable answer is communicated to the student or player. In the past, cue cards and the like were used to present the question on one side while bearing the correct answer on the reverse side thereof. It was intended that the answer not be revealed until the one being questioned gave an answer, the accuracy or correctness being apparent when the card was turned over. Such prior art teaching devices and aids provide little entertainment as well as not being suited for use by younger children alone without the aid of a teacher or parent.

Various types of electric apparatus have been evolved which emit a buzz or bell upon the placement of a wand or the like against a series of contacts which bear answers. These mechanical devices were limited as to the amount of questions and subject matter that could be covered and are somewhat expensive to produce. Furthermore, these devices are not suitable for younger children that do not understand how the device works.

Other types of educational games are known in the art, but are not especially adapted to be used with an extremely wide range of subject matters, and are not interesting so as to encourage the use thereof.

SUMMARY OF THE INVENTION

This invention overcomes the disadvantages of the prior art games and teaching aids by providing an educational puzzle which can be easily used by young infants as well as adults. The puzzle is easily manufactured and suitable for use with any number of pieces or components desired, as well as being suitable to be made of a wide range of readily available materials.

The structure of the invention features the use of a plurality of substantially flat components each having at least one counterpart edge that is intended to be placed into coextensive engagement with a counterpart edge located on another of the components. Printed matter is provided on each component located along and associated with each counterpart edge which indicates a pair of counterpart edges located on separate components which are complementary and intended to be placed in juxtaposition. The designated pairs of complementary counterpart edges are of complementary shape so when they are placed in the proper position the components form a predetermined final shape or figure.

It is an object of the present invention to provide an educational puzzle that can be easily handled and placed in position by extemely young children of an age group that would be learning basic number, letter or simple figure recognition.

Further, it is an object of the present invention to provide an educational puzzle that is suitable for use by people by any educational level.

Another object of the present invention is to provide a game or puzzle that serves as a teaching aid which provides positive reinforcement when predetermined questions and answers are appropriately matched.

A still further object and feature of this puzzle resides in the provision that it may be manufactured to bear a wide range of questions to correspond to any degree of education and to form a predetermined figure that would correspond to the type of questions presented.

Still further objects and features of this invention reside in the provision of an edcuational puzzle that is inexpensively manufactured, simple in construction, thereby permitting wide use and distribution. Furthermore, the components of the educational puzzle may be made of inexpensive and easily obtainable materials such as paper, plastic, and the like which are suitable to receive printing and which may be made in a wide variety of colors or patterns.

These, together with the various ancillary objects and features of the invention which will become apparent as the following description proceeds, are attained by this display device, preferred embodiments of which are shown in the accompanying drawing, by way of example only, wherein:

BRIEF DESCRIPTION OF THE DRAWING

FIG. 1 is a plan view of a component of the invention;

FIG. 2 is a plan view of another embodiment of a component of the invention;

FIG. 3 is a plan view of a still further embodiment of a component of the invention;

FIG. 4 is a plan view of the invention showing the components of the embodiment of FIG. 1 slightly spaced from one another;

FIG. 5 is a plan view of one embodiment of the invention depicting the use of a plurality of educational puzzles.

DETAILED DESCRIPTION OF THE INVENTION

Figure 6:
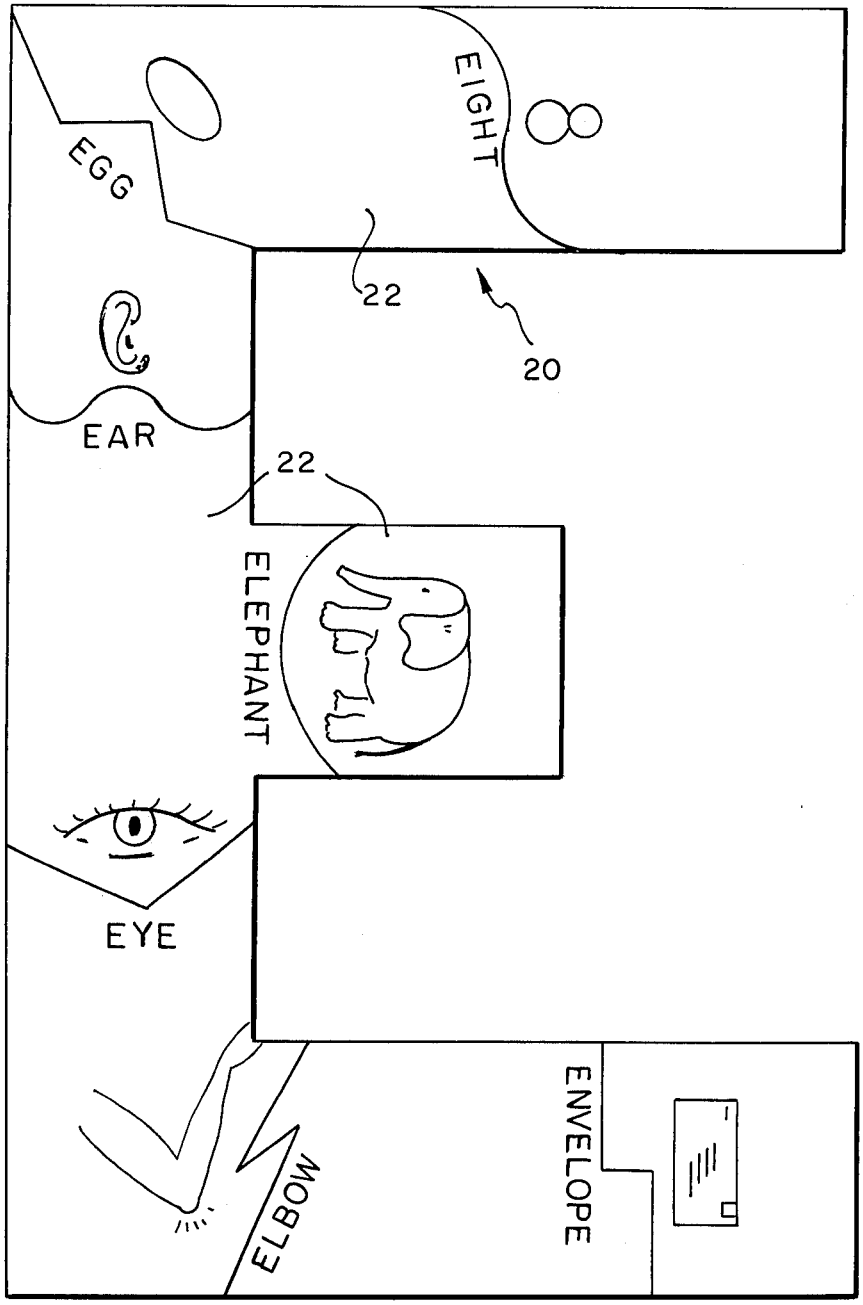
FIG. 6 is a plan view of a still further embodiment of the invention.

With continuing reference to the accompanying drawing wherein like reference numerals designates similar parts throughout the various views, reference numeral 20 is used to generally designate an educational puzzle constructed in accordance with the concepts of the present invention. The puzzle 20 includes a plurality of substantially flat components 22 which include at least one counterpart or mating edge 24, 26, 28, 30, 32 and 34 which is intended to be placed in juxtaposition with a counterpart edge located on another component 22. The components 22 may be of any thickness, but are preferably thick enough to facilitate easy handling. The components 22 may be manufactured of any suitable material such as paper, cardboard or synthetic materials such as plastic or the like. It is intended that the puzzle be inexpensively manufactured from readily obtainable materials, and that the product be safe for use by infants. Accordingly, materials such as cardboard and plastic are preferred. It is within the scope of the present invention that the components be colored if desired so that all components of one educational puzzle are of one uniform color.

Every component 22 has a printed portion 40, 42, 44, 46, 48 and 50 located on one side thereof. There is a printed portion on each component 22 located in close proximity to each counterpart edge of the component and is therefore associated therewith. It is within the scope of the present invention that the printed portion may be printed on the component by any suitable process that is compatible with the material that the component 22 is manufactured of, such as a silk screen or photolithograph process or the like, as well as including raised letters or symbols, as well as depressed or embossed indicia. Furthermore, any sort of suitable surface to receive pencil or ink markings may be disposed in close proximity to a counterpart edge such as 24 or 26 or the like whereby conventional writing instruments may be utilized to place symbols, letters or numerals thereon.

The printed portions 41 and 43 for example cooperate to indicate a pair of counterpart edges such as 60 and 62 located on separate components which are complementary and intended to be placed in juxtaposition, as may be seen in FIG. 4. As may be readily understood the two printed portions which are associated with a pair of complementary counterpart edges may be a mathematical problem, and a corresponding correct answer. More precisely, printed portion 64 might be an equation such as "2 × 3 =", and printed portion 66 be "6". Accordingly, the printed portions associated with a pair of complementary counterpart edges would cooperate to indicate that the edges 68 and 70 are to be brought into coextensive engagement. It may be easily understood that the printed portions may be a question and answer, joke and punch line, and simple indicia such as geometric shapes, and the like. If simple shapes or figures are utilized for the printed portions, then the same exact figure or indicia could be placed along each one of the pair of counterpart complementary edges to designate that they are to be placed into juxtaposition. Accordingly, each pair of printed portions associated with a pair of edges that are intended to be mated would be different.

It is within the scope of this invention that a pair of complementary printed portions that are associated with a pair of complementary counterpart edges may indicate that they are intended to be mated, by including various designations. For example, a printed portion might comprise a question such as "What is the capitol of the United States", while the complementary portion would be the corresponding correct answer "Washington, D.C.". As may be readily appreciated the printed portions could comprise any sort of advanced mathematics such as calculus problems and corresponding answers as well as a symbol of an electrical component or the like and the corresponding component designated in any language desired. Furthermore, for example, the printed portions corresponding to one pair of complementary counterpart edges might be a single word in English and in German. However, each pair of printed portions included within one puzzle 20 would include different questions and answers, or the like, so that there would only be one proper counterpart edge that should be placed into coextensive engagement with one other counterpart edge to form a pair of complementary counterpart edges.

The counterpart edges that are intended to be matched are of complementary shape so that they may be placed into coextensive engagement. When all the components 22 of a single puzzle 20 are placed into the proper position a countinuous predetermined final figure such as 70, or the like, is formed. It is within the scope of the present invention that the shape of a counterpart edge may be of an irregular configuration so as to indicate visually the corresponding counterpart edge. However, an edge such as 28 or 32 may be straight or slightly curved. As may be readily understood if every counterpart edge in a single educational puzzle is the same shape the proper positioning of the components may be ascertained by using the printed portions only. However, by changing the shapes of the counterpart edges within a puzzle both the shape and the printed portions would indicate how the components are to be placed with respect to one another.

It is also within the scope of the present invention that the final figure produced corresponds to the content of the printed portions. For example, if the printed portions contain mathematical problems such as 2 times intergers 1 through 9, the predetermined final figure could be a "2" which corresponds to the common multiplier in each of the mathematical problems. Furthermore it is understood that any common element present in the question portions of a printed portion may be utilized as the predetermined final configuration of the puzzle.

A plurality of puzzles 20 of various final shapes may be used to form a composite final figure 80, that correspond to one another if desired. Such a plurality of puzzles which may have printed portions including advanced mathematics for example, could form the elements of an advanced mathematical equation such as that depicted in FIG. 5. Furthermore, each component of each discrete puzzle 20 of the group or composite might be color-coded to indicate which components correspond to which puzzle.

A latitude of modification, substitution and change is intended in the foregoing disclosure, and in some instances, some features of the present invention may be employed without a corresponding use of other features.

What is claimed is:

1. An educational puzzle comprising a plurality of substantially flat components each having at least one counterpart edge that is intended to be placed in juxtaposition with the counterpart edge of another said component, a printed portion on each component located along and associated with each said counterpart edge on each said component, said printed portions including a plurality of pairs of said printed portions which cooperate to indicate counterpart edges located on separate components which are complementary and are intended to be placed in juxtaposition, said complementary edges being of complementary shape so that they may be placed into substantially coextensive engagement, each of said pairs of said printed portions being different than the other said pairs of said printed portions, at least one of said components having at least two printed portions spaced from each other located along discrete edges of said component to indicate at least two distinct counterpart edges thereon, so that when all said complementary counterpart edges on said components of said puzzle are placed in the proper juxtaposition indicated by said pairs of printed portions a predetermined figure is formed, said predetermined figure having a relationship to each of said pairs of said printed portions, one of said printed portions of each said pair of printed portions including a mathematical problem, and the other printed portion of each said pair including a correct answer to said mathematical problem, each of said mathematical problems being a different mathematical problem and an appropriate answer, said mathematical problems including multiplication, and each said problem including a common multiplier, and said predetermined figure being substantially the shape of said common multiplier.

2. An educational puzzle comprising a plurality of substantially flat components each having at least one counterpart edge that is intended to be placed in juxtaposition with the counterpart edge of another said component, a printed portion on each component located along and associated with each said counterpart edge on each said component, said printed portions including a plurality of pairs of said printed portions which cooperate to indicate counterpart edges located on separate components which are complementary and are intended to be placed in juxtaposition, said complementary edges being of complementary shape so that they may be placed into substantially coextensive engagement, each of said pairs of said printed portions being different than the other said pairs of said printed portions, at least one of said components having at least two printed portions spaced from each other located along discrete edges of said component to indicate at least two distinct counterpart edges thereon, so that when all said complementary counterpart edges on said components of said puzzle are placed in the proper juxtaposition indicated by said pairs of printed portions a predetermined figure is formed, said predetermined figure having a relationship to each of said pairs of said printed portions, one of said printed portions of each said pair of printed portions including a mathematical problem, and the other printed portion of each said pair including a correct answer to said mathematical problem, each of said mathematical problems being a different mathematical problem and an appropriate answer, said mathematical problems including subtraction, and each said problem including a common subtrahend, and said predetermined figure being substantially the shape of said common subtrahend.

* * * * *